US011523230B2

(12) United States Patent
Dominijanni

(10) Patent No.: US 11,523,230 B2
(45) Date of Patent: Dec. 6, 2022

(54) EARPIECE WITH MOVING COIL TRANSDUCER AND ACOUSTIC BACK VOLUME

(71) Applicant: Bose Corporation, Framingham, MA (US)

(72) Inventor: Andrew D. Dominijanni, Waltham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 17/120,486

(22) Filed: Dec. 14, 2020

(65) Prior Publication Data

US 2022/0191626 A1 Jun. 16, 2022

(51) Int. Cl.
*H04R 25/00* (2006.01)

(52) U.S. Cl.
CPC ..... *H04R 25/402* (2013.01); *H04R 25/456* (2013.01); *H04R 25/607* (2019.05); *H04R 25/652* (2013.01)

(58) Field of Classification Search
CPC .. H04R 25/407; H04R 25/405; H04R 25/402; H04R 25/552; H04R 25/65; H04R 25/652; H04R 25/658; H04R 25/604; H04R 25/60; H04R 25/456; H04R 3/005; H04R 2225/61; H04R 2225/025; H04R 1/1008; H04R 1/1016; H04R 1/1066;
(Continued)

(56) References Cited

U.S. PATENT DOCUMENTS

| | | | |
|---|---|---|---|
| 7,079,662 | B2 | 7/2006 | Niederdrank |
| 10,425,714 | B2 | 9/2019 | Lawand et al. |
| 10,542,341 | B2 | 1/2020 | Higgins |

(Continued)

FOREIGN PATENT DOCUMENTS

| | | | |
|---|---|---|---|
| EP | 2765788 | A1 | 8/2014 |
| EP | 3177033 | A1 | 7/2017 |
| EP | 3672279 | A1 | 6/2020 |

OTHER PUBLICATIONS

PCT International Search Report and Written Opinion for International Application No. PCT/US2021/062003, dated Apr. 4, 2022, 18 pages.

*Primary Examiner* — Ahmad F. Matar
*Assistant Examiner* — Sabrina Diaz
(74) *Attorney, Agent, or Firm* — Hoffman Warnick LLC

(57) ABSTRACT

Various implementations include audio devices and related earpieces. In certain implementations, an earpiece includes an electro-acoustic transducer and an acoustic back volume configured to provide a desirable fit along with desirable acoustic performance. In some particular aspects, an earpiece includes: an electro-acoustic transducer; a housing supporting the electro-acoustic transducer such that the housing and the electro-acoustic transducer together define a first acoustic volume and a second acoustic volume, the electro-acoustic transducer being arranged such that a first radiating surface of the transducer radiates acoustic energy into the first acoustic volume coupled to an outlet and such that a second radiating surface of the transducer radiates acoustic energy into the second acoustic volume, where at least a portion of the second acoustic volume is located between the first radiating surface and the outlet.

23 Claims, 7 Drawing Sheets

(58) Field of Classification Search
CPC .... H04R 1/1058; H04R 1/1075; H04R 5/033; H04R 5/0335; H04R 2201/107; H04R 2420/07
USPC ..... 381/313, 328, 322, 324, 370, 371, 380
See application file for complete search history.

(56) References Cited

U.S. PATENT DOCUMENTS

| | | | | |
|---|---|---|---|---|
| 10,674,246 | B2 | 6/2020 | Vos et al. | |
| 11,234,085 | B2 | 1/2022 | Dominijanni et al. | |
| 2004/0218772 | A1 | 11/2004 | Ryan | |
| 2006/0137934 | A1 | 6/2006 | Kurth | |
| 2006/0269090 | A1 | 11/2006 | Sapiejewski | |
| 2007/0014423 | A1 | 1/2007 | Darbut et al. | |
| 2007/0036385 | A1 | 2/2007 | Harvey et al. | |
| 2007/0201717 | A1 | 8/2007 | Dyer et al. | |
| 2008/0013767 | A1 | 1/2008 | Olsen et al. | |
| 2009/0180657 | A1 | 7/2009 | Isvan | |
| 2009/0196444 | A1 | 8/2009 | Solum | |
| 2010/0086158 | A1* | 4/2010 | Oberlander ..... | H04R 25/652 381/328 |
| 2011/0280425 | A1 | 11/2011 | Gibbons | |
| 2011/0293123 | A1 | 12/2011 | Neumeyer et al. | |
| 2012/0070022 | A1* | 3/2012 | Saiki ..... | H04R 9/063 381/351 |
| 2012/0106774 | A1 | 5/2012 | Saiki | |
| 2012/0201406 | A1 | 8/2012 | Yamaguchi | |
| 2013/0028434 | A1* | 1/2013 | Sibbald ..... | H04R 1/1091 381/71.6 |
| 2013/0148830 | A1 | 6/2013 | Sakaguchi et al. | |
| 2013/0315412 | A1* | 11/2013 | Annunziato ..... | H04R 3/002 381/71.6 |
| 2014/0169584 | A1 | 6/2014 | Narayan | |
| 2014/0348372 | A1 | 11/2014 | Seo et al. | |
| 2014/0355810 | A1 | 12/2014 | Perkmann et al. | |
| 2015/0264467 | A1 | 9/2015 | Annunziato et al. | |
| 2016/0192065 | A1 | 6/2016 | Oosato et al. | |
| 2017/0223443 | A1 | 8/2017 | Silvestri et al. | |
| 2018/0115839 | A1 | 4/2018 | Eichfeld et al. | |
| 2018/0359578 | A1 | 12/2018 | Boley | |
| 2019/0075384 | A1* | 3/2019 | Miwa ..... | H04R 1/1075 |
| 2019/0182576 | A1* | 6/2019 | Pierce ..... | H04R 1/1016 |
| 2019/0356991 | A1 | 11/2019 | Farver | |
| 2020/0178003 | A1* | 6/2020 | Zurbruegg ..... | H04R 1/1016 |
| 2020/0383613 | A1 | 12/2020 | Patnala | |
| 2021/0099811 | A1 | 4/2021 | Roeck et al. | |
| 2021/0152924 | A1 | 5/2021 | Keady | |
| 2021/0211811 | A1 | 7/2021 | Fritzsche et al. | |
| 2022/0007097 | A1* | 1/2022 | Ko ..... | H04R 1/1075 |

* cited by examiner

EARPIECE WITH MOVING COIL TRANSDUCER AND ACOUSTIC BACK VOLUME

TECHNICAL FIELD

This disclosure generally relates to acoustic earpieces. More particularly, the disclosure relates to an earpiece with an electro-acoustic transducer in a wearable audio device.

BACKGROUND

The design and manufacture of wearable audio devices such as in-ear, on-ear or near-ear audio devices can present a number of challenges. In particular cases, it is difficult to achieve both desirable sizing and acoustic performance constraints in given device. That is, some conventional audio devices fail to provide adequate acoustic performance within a desired form factor.

SUMMARY

All examples and features mentioned below can be combined in any technically possible way.

Various implementations of the disclosure include audio devices and related earpieces. In certain implementations, an earpiece includes an electro-acoustic transducer (e.g., a moving coil transducer) and an acoustic back volume configured to provide a desirable fit along with desirable acoustic performance. In some cases, the earpiece is part of a hearing aid, an on-ear audio device and/or an in-ear audio device.

In some particular aspects, an earpiece includes: an electro-acoustic transducer; a housing supporting the electro-acoustic transducer such that the housing and the electro-acoustic transducer together define a first acoustic volume and a second acoustic volume, the electro-acoustic transducer being arranged such that a first radiating surface of the transducer radiates acoustic energy into the first acoustic volume coupled to an outlet and such that a second radiating surface of the transducer radiates acoustic energy into the second acoustic volume, where at least a portion of the second acoustic volume is located between the first radiating surface and the outlet.

Implementations may include one of the following features, or any combination thereof.

In certain aspects, the electro-acoustic transducer includes a moving coil transducer.

In particular cases, the housing has a longitudinal axis, and the moving coil transducer includes a diaphragm with a motion axis that is approximately parallel with the longitudinal axis of the housing.

In some implementations, the housing defines a nozzle, and the first acoustic volume is acoustically coupled to an acoustic passage in the nozzle such that the electro-acoustic transducer is acoustically coupled to the user's ear canal when the earpiece is worn.

In certain cases, the earpiece further includes an ear tip supported on the nozzle, where the ear tip is either configured to: form a tight acoustic seal with a user's ear canal when the earpiece is worn, or the ear tip includes a set of apertures that allow acoustic energy to move into and out of the user's ear canal.

In particular aspects, the housing defines a main body having a first longitudinal axis and a nozzle having a second longitudinal axis that intersects with the first longitudinal axis, where the electro-acoustic transducer is supported in the main body and such that a motion axis of the electro-acoustic transducer is substantially parallel to the first longitudinal axis, and where the first and second longitudinal axes are arranged at a non-zero angle relative to each other.

In some cases, the outlet is at least partially covered by at least one of: a screen, a mesh material, a thin foam, a reticulated foam, an open-cell foam, an expanded polymer, or a dome cover.

In particular aspects, the earpiece further includes a rear port coupling the second acoustic volume with a space outside the housing.

In certain implementations, the earpiece further includes a front port coupling the first acoustic volume with a space outside the housing.

In some aspects, the front port and the rear port are acoustically coupled into a combined exit volume.

In some cases, the second acoustic volume has an approximately constant cross-sectional width across a length thereof.

In particular implementations, the second acoustic volume includes at least two acoustically coupled sub-volumes.

In certain aspects, the acoustically coupled sub-volumes have distinct volumes.

In particular implementations, a ratio between a first sub-volume in the acoustically coupled sub-volumes and a second sub-volume in the acoustically coupled sub-volumes is equal to approximately 1:1 to approximately 4:1.

In certain aspects, a ratio between a first sub-volume in the acoustically coupled sub-volumes and a second sub-volume in the acoustically coupled sub-volumes is equal to approximately 2:1 to approximately 4:1.

In some aspects, a ratio between a first sub-volume in the acoustically coupled sub-volumes and a second sub-volume in the acoustically coupled sub-volumes is equal to approximately 3:1.

In particular cases, the acoustically coupled sub-volumes include at least three acoustically coupled sub-volumes, including: a first sub-volume having a first volume; a second sub-volume having a second volume; and a third sub-volume having a third volume, where the second sub-volume is smaller than each of the first sub-volume and the third sub-volume and acts as a port between the first sub-volume and the third sub-volume.

In some implementations, the acoustically coupled sub-volumes includes at least three acoustically coupled sub-volumes, including: a first sub-volume having a first volume; a second sub-volume having a second volume; and a third sub-volume having a third volume, where the second sub-volume acts as a waveguide that acoustically couples the first sub-volume and the third sub-volume.

In certain aspects, the housing includes a contour configured to complement a user's ear canal shape.

In particular implementations, the first acoustic volume and the second acoustic volume are separated by a wall, where at least a portion of the wall is located between the first radiating surface and the outlet.

In some cases, the earpiece further includes a microphone in the portion of the wall located between the first radiating surface and the outlet.

In certain implementations, the second acoustic volume is at least approximately 75 cubic millimeters ($mm^3$).

In particular aspects, the earpiece is part of a hearing aid, the hearing aid further including: a casing configured to sit behind a user's pinna when worn; and wiring coupling the casing to the earpiece.

In certain cases, the hearing aid further includes: a battery, a microphone and a sound processor housed in the casing.

In some implementations, the earpiece is part of an in-ear audio device.

In certain cases, the earpiece is part of an on-ear audio device.

Two or more features described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

Figure 1:
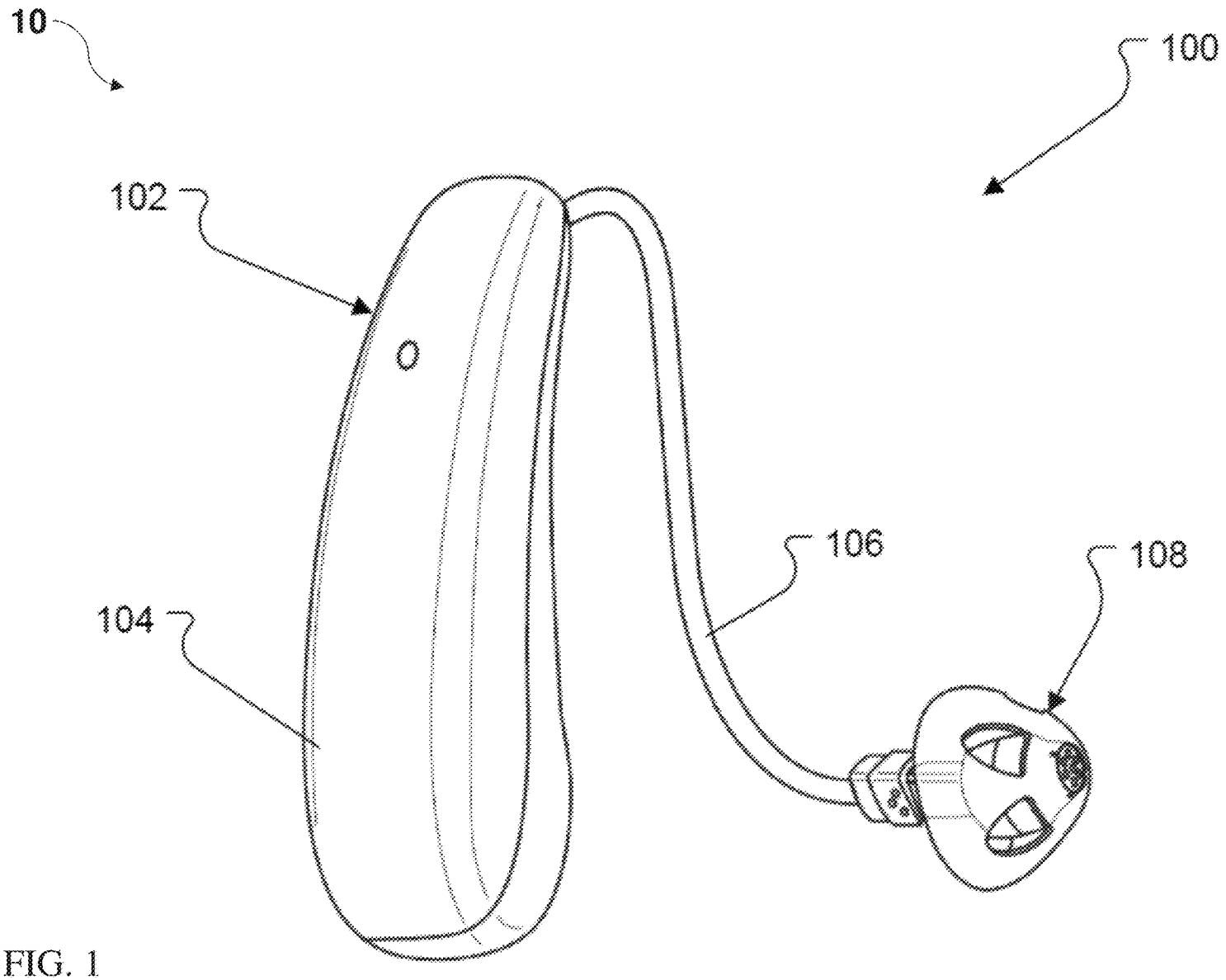
FIG. 1 is a schematic depiction of an audio device including a receiver-in-canal (RIC) hearing aid according to various implementations.

It is noted that the drawings of the various implementations are not necessarily to scale. The drawings are intended to depict only typical aspects of the disclosure, and therefore should not be considered as limiting the scope of the invention. In the drawings, like numbering represents like elements between the drawings.

DETAILED DESCRIPTION

As noted herein, various aspects of the disclosure generally relate to wearable audio devices such as in-ear, on-ear and/or near-ear audio devices with an earpiece having an electro-acoustic transducer (e.g., moving coil transducer) and an acoustic back volume configured to provide a desirable fit along with acoustic performance. In certain cases, the audio device includes a receiver-in-canal (RIC) hearing aid or another form of hearing aid with a transducer mounted within the in-canal section.

Commonly labeled components in the FIGURES are considered to be substantially equivalent components for the purposes of illustration, and redundant discussion of those components is omitted for clarity.

Aspects and implementations disclosed herein may be applicable to a wide variety of wearable audio devices. In some cases, wearable audio devices can take various form factors, such as headphones (whether on or off ear), headsets, watches, eyeglasses, audio accessories or clothing (e.g., audio hats, audio visors, audio jewelry), a helmet (e.g., for military, industrial, or motorcycle applications), neck-worn speakers, shoulder-worn speakers, body-worn speakers, etc. Some aspects disclosed may be particularly applicable to personal (wearable) audio devices such as over-ear headphones, on-ear headphones, in-ear headphones (also referred to as earbuds), audio eyeglasses or other head-mounted audio devices. As noted herein, some disclosed aspects may be particularly applicable to in-ear or on-ear headphones, and earpieces in such headphones.

The wearable audio devices described according to various implementations can include features found in one or more other wearable electronic devices, such as smart glasses, smart watches, etc. These wearable audio devices can include additional hardware components, such as one or more cameras, location tracking devices, microphones, etc., and may be capable of voice recognition, visual recognition, and other smart device functions. The description of wearable audio devices included herein is not intended to exclude these additional capabilities in such a device.

As noted herein, conventional wearable audio devices, in particular those designed to rest in or near the user's ear canal, can fail to effectively balance desired fit with acoustic performance. For example, in a RIC hearing aid or in-ear audio device, it can be desirable to position the transducer (or, driver) as far into the user's ear canal as possible (e.g., toward the acoustic outlet) in order to aid with feedback noise cancelation. That is, it can be beneficial to position the transducer and feedback microphone close to the ear drum to enhance feedback noise cancelation. However, positioning the transducer closer to the acoustic outlet can increase the outer dimension of the in-ear portion (in some cases referred to as the in-canal portion) of the device, impacting the fit within the user's ear.

In contrast to conventional devices, the wearable audio devices disclosed according to various implementations include at least one earpiece with an electro-acoustic transducer and an acoustic volume (e.g., back-volume) that spans from a region behind the transducer to a region that is at least partially in front of the transducer. In these implementations, the transducer can be set back relative to the acoustic outlet. With the transducer set back from the outlet, the outer dimension of the in-canal, in-ear, on-ear or near-ear portion of the audio device can be sized to enhance fit, e.g., by narrowing the outer dimension of that portion. In certain cases, such as where the audio device is a RIC hearing aid with a casing separated from the earpiece, the earpiece enables use of an electro-acoustic (e.g., moving coil) transducer with a comfortable, consistent fit in the user's canal. In some cases, the RIC hearing aid disclosed according to various implementations has an earpiece with a contour configured to complement a user's ear canal shape.

FIG. 1 shows an example wearable audio device 10, which in this example takes the form of a receiver-in-canal (RIC) hearing aid 100. The RIC hearing aid 100 includes a behind-the-ear portion 102 that includes a battery, a microphone, and a sound processor housed in a casing 104 designed to sit behind a user's ear (pinna). This behind-the-ear portion 102 of the hearing aid 100 has a small wire 106 designed to run around the user's ear and into an earpiece 108 that is designed to sit in the user's ear canal. The earpiece 108 carries a speaker, also known as the "receiver" or "driver." In various implementations, and in contrast to conventional RIC hearing aids, the speaker includes an electro-acoustic transducer such as a moving coil transducer. Conventionally, RIC hearing aids employ balanced armature-type speakers such as those disclosed in U.S. Pat. No. 10,674,246 (filed on Apr. 27, 2018, the complete disclosure of which is incorporated herein by reference). These balanced-armature devices require little or nominal back-volume to balance the acoustic output of the speaker, and are often oriented such that the motion axis of the speaker is perpendicular to the outlet of the earpiece. However, balanced-armature devices have shortcomings, such as a lack of sensitivity in creating sound pressure at low frequencies.

Additionally, balanced-armature devices are limited in their maximum displacement, thereby limiting the peak low-frequency sound pressure that can be created without distortion. As such, balanced-armature devices can exhibit unacceptable distortion in trying to respond to loud, low-frequency events such as loud speech, doors slamming, the user's own voice, etc.

In contrast to earpieces employing balanced-armature speakers, various implementations include an earpiece having an electro-acoustic transducer that is positioned to enable both desired fit and acoustic performance. In certain implementations, the electro-acoustic transducer includes a moving coil transducer with a low stiffness that is capable of large displacement, enabling effective active noise reduction at low frequencies. However, as noted herein, moving coil transducers benefit from a relatively larger back volume when compared with balanced-armature speakers. The earpieces disclosed according to various implementations provide the acoustic benefits of an electro-acoustic transducer, along with corresponding back volume, in a compact, discrete form factor.

Figure 2:
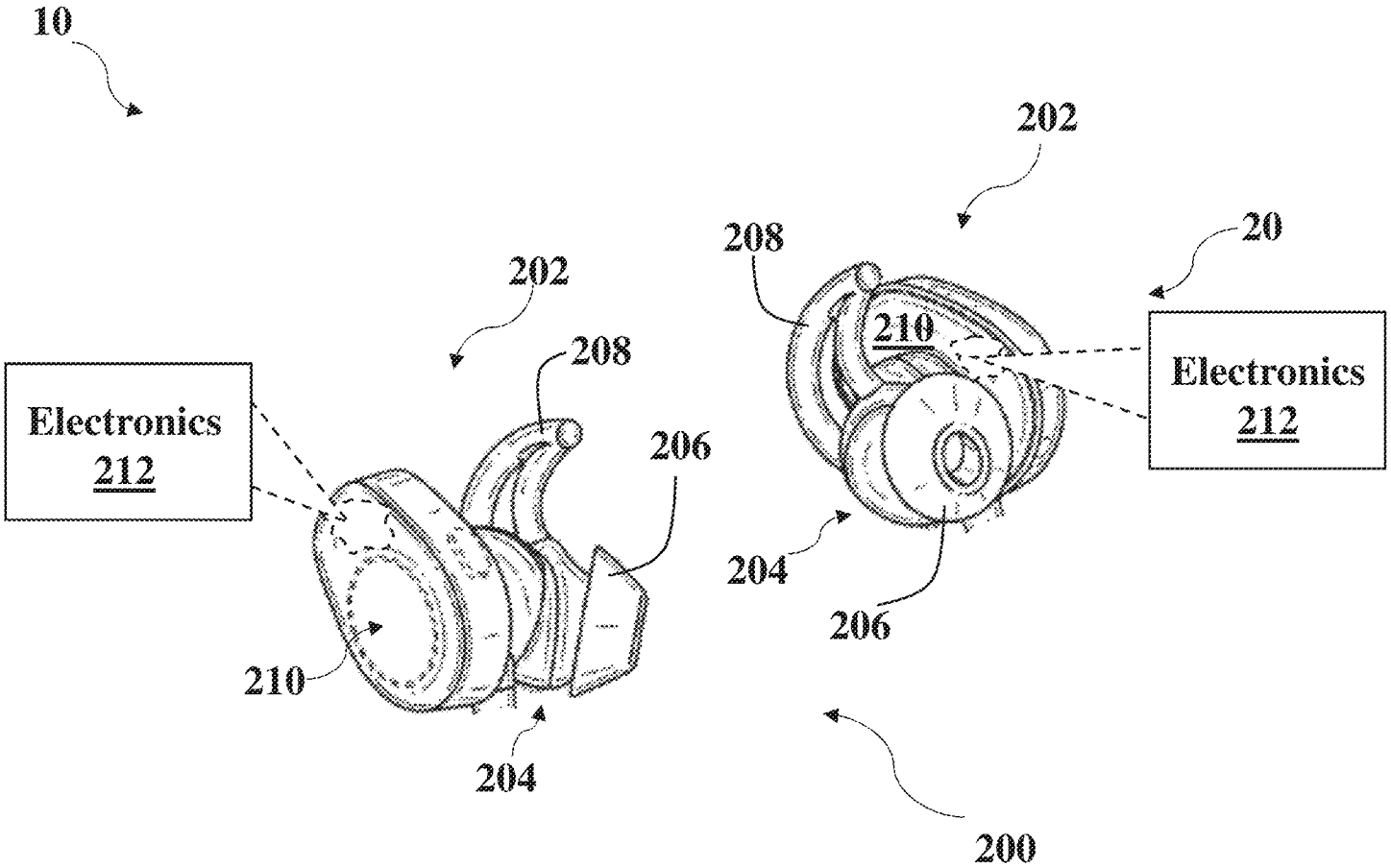
FIG. 2 is a schematic depiction of another audio device according to various implementations.

FIG. 2 is a schematic depiction of another example wearable audio device 10, which in this case takes the form of an in-ear or on-ear audio device such as an audio headset 200 having at least one earbud (or, in-ear headphone) 202. Two earbuds 202 are illustrated in this example. While the earbuds 202 are shown in a "true" wireless configuration (i.e., without tethering between earbuds 202), the audio headset 200 could also include a tethered wireless configuration (whereby the earbuds 202 are connected via wire with a wireless connection to a playback device) or a wired configuration (whereby at least one of the earbuds 202 has a wired connection to a playback device). Each earbud 202 is shown including an earpiece 204, which can include a housing formed of one or more plastics or composite materials. The earpiece 204 can include a nozzle 206 for insertion into a user's ear canal entrance, and a support member 208 for retaining the nozzle 206 in a resting position within the user's ear. In certain cases, the nozzle 206 and/or support member 208 are part of a removable casing that can be cleaned, repositioned and/or replaced to enhance fit within the user's ear. In other cases, the nozzle 206 and/or support member 208 are integral with the earpiece 204. According to certain implementations, the earpiece 204 further includes an outer casing 210 for housing electronics 212, including components such as a battery, a microphone, and a sound processor. In some cases, separate, or duplicate sets of electronics 212 are contained in portions of the earbuds 202, e.g., each of the respective earbuds 202. However, certain components described herein can also be present in singular form.

Figure 3:
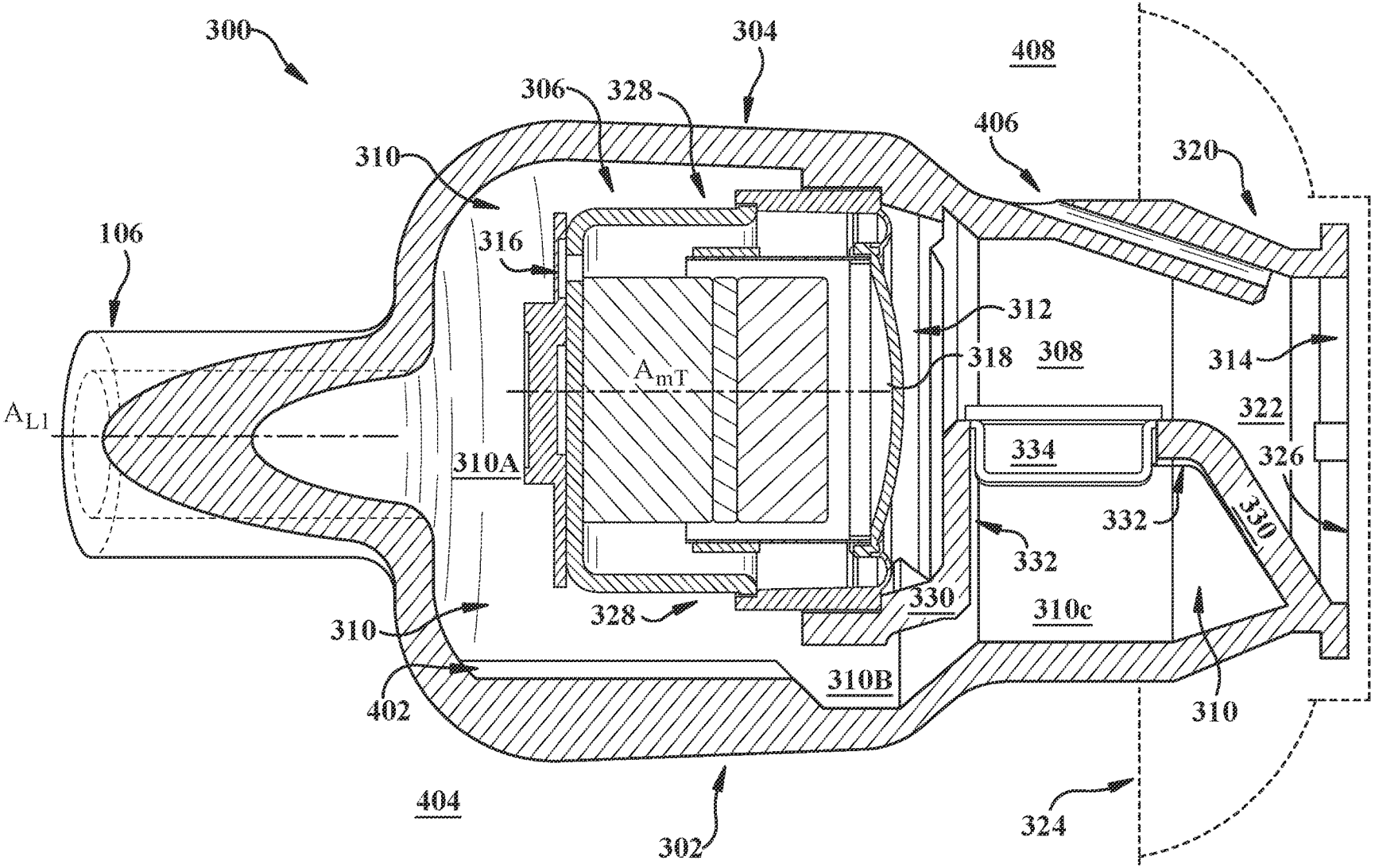
FIG. 3 is a cross-sectional depiction of an earpiece in an audio device according to various implementations.

FIG. 3 is a schematic cross-sectional view of a portion of an earpiece 300 in an audio device such as the RIC hearing aid 100 (FIG. 1) and/or the audio headset 200, according to various implementations. It is understood that the earpiece 300 can also be part of a number of other on-ear, in-ear, around-ear and/or near-ear audio devices in various form factors, examples of which are described in U.S. Patent Application No. 63/044,078, filed on Jun. 25, 2020, the complete disclosure of which is incorporated herein by reference.

In certain implementations, the earpiece 300 includes an earbud 302 that includes a housing 304 supporting an electro-acoustic transducer 306 (or, speaker or driver). In various implementations, the electro-acoustic transducer 306 is a moving coil transducer. The electro-acoustic transducer 306 may be a full range microdriver, e.g., having a diaphragm less than 6 mm in diameter, e.g., between 3 mm and 5.5 mm in diameter, e.g., 4.3 mm to 5.4 mm in diameter, such as those described in U.S. Pat. No. 9,942,662, titled "Electroacoustic driver having compliant diaphragm with stiffening element," and issued on Apr. 10, 2018, and/or U.S. Pat. No. 10,609,489, titled "Fabricating an integrated loudspeaker piston and suspension," issued on Mar. 31, 2020, the complete disclosures of which are incorporated herein by reference. As used herein "full range" is intended to mean capable of producing frequencies from about 20 Hz to about 20 kHz.

Together, the housing 304 and the electro-acoustic transducer 306 define a first (front) acoustic volume 308 and a second (rear) acoustic volume 310. While a portion of the second acoustic volume 310 is located at or near the rear of the electro-acoustic transducer 306, as described herein, a portion of the second acoustic volume 310 can also be located in front of, or peripheral to, the electro-acoustic transducer (or simply, transducer) 306. That is, the transducer 306 is arranged in various implementations such that a first radiating surface 312 of the transducer 306 radiates acoustic energy into the first acoustic volume 308, which is in turn coupled to an outlet 314. The transducer 306 is also arranged such that a second radiating surface 316 of the transducer 306 radiates acoustic energy into the second acoustic volume 310. In certain implementations, the housing 304 has a first longitudinal axis ($A_{L1}$), and the transducer 306 has a diaphragm 318 with a motion axis ($A_m$T) that is approximately parallel with the longitudinal axis of the housing 304.

In various implementations, the housing 304 defines a nozzle 320 proximate the outlet 314, and the first acoustic volume 308 is acoustically coupled to an acoustic passage 322 in the nozzle 320 such that the transducer 306 is acoustically coupled to the user's ear canal when the earpiece 300 is worn. In particular cases, the earpiece 300 includes an ear tip 324 supported on the nozzle 320 and configured to couple with the user's ear canal when the earpiece is worn. The ear tip 324 is shown as phantom as optional, and in some cases, resembles ear tip 206 in FIG. 2 (e.g., a dome cover). In some cases, the ear tip 324 provides a tight acoustic seal with the user's ear canal when the earpiece 300 is worn. In other cases, the ear tip 324 may include a set of one or more apertures allowing acoustic energy to move into and out of the user's ear canal with little resistance. In certain examples, a resistive element, such as a resistive screen, may be provided in or overlying one or more of the apertures, e.g., for providing a desired impedance response. In particular cases including an ear tip, the nozzle 320 can include a lip, rim, protrusion, or other mating feature for coupling with the ear tip. Example variations on ear tips that can be employed with the earpiece 300 according to implementations are described in U.S. application Ser. No. 16/690,586, filed Nov. 21, 2019, the complete disclosure of which is incorporated herein by reference. In such cases, an ear tip (of any variety) is coupled with the outlet 314, and in particular cases, is sized to couple with the nozzle 320. In certain aspects, the ear tip fits over the nozzle 320 in the earpiece 300 and enhances acoustic coupling with the user's ear canal. However, as noted herein, the earpiece 300 can be used without an ear tip (e.g., as depicted in the example earpiece 400 in FIG. 4), such that the outlet is positioned proximate the entrance to the user's ear canal, or on the user's ear. In these cases, the outlet 314 is positioned to direct sound toward the user's ear canal, but need not necessarily be tightly sealed to the ear canal. In certain cases, a support member (e.g., such as support member 208 in FIG.

2, or an over-ear, over-head, or on-ear support member) is coupled with the earpiece 300 and configured to position the earpiece 300 on or near the user's ear.

In certain implementations, the outlet 314 is at least partially covered by a protective material 326. In certain cases, the protective material 326 is part of an ear tip (e.g., ear tip 324), however, in other cases, the protective material 326 is coupled with the housing 304 proximate the outlet 314. Examples of protective material 326 can include one or more of: a screen, a mesh material, a wax guard, a thin foam, a reticulated foam, an open-cell foam, or an expanded polymer (e.g., ePTFE). Examples of other protective materials 326 (e.g., screens) compatible with the earpiece 300 are described in detail in U.S. application Ser. No. 16/690,586, previously incorporated by reference herein. Protective material(s) 326 can be coupled with and/or integrated with the outlet 314 or any acoustic opening in the earpiece 300, and in some cases, can be secured using a counter-bore port features such as those described in U.S. application Ser. No. 16/828,327, filed Mar. 23, 2020, the complete disclosure of which is incorporated herein by reference.

As illustrated in the example implementation in FIG. 3, at least a portion of the second acoustic volume 310 is located between the first radiating surface 312 of the transducer 306 and the outlet 314. That is, the second acoustic volume 310 spans from a space behind the transducer 306 ("behind" relative to outlet 314) to a space at least partially in front of the transducer 306. In certain cases, a portion of the second acoustic volume 310 spans peripherally relative to the transducer 306, e.g., axially (along the motion axis ($A_{mT}$) of the transducer 306), along a sidewall 328 of the transducer 306. In other terms, a portion of the second acoustic volume 310 spans axially from the space behind the transducer 306 to the space at least partially in front of the first radiating surface 312 of the transducer 306.

In certain example implementations, the first acoustic volume 308 and the second acoustic volume 310 are separated by a wall 330. In various implementations, at least a portion 332 of the wall 330 is located between the first radiating surface 312 and the outlet 314. In certain cases, as illustrated in the example configuration depicted in FIG. 3, a microphone (e.g., a feedback microphone) 334 is located in the portion 332 of the wall 330 located between the first radiating surface 312 and the outlet 314. In other cases, the microphone 334 is located in a distinct wall in the housing 304, e.g., a sidewall of the housing 304 that is between the first radiating surface 312 and the outlet 314. In still further cases, the microphone 334 is mounted to any wall in the housing 304 that enables the inlet of the microphone 334 to access the first acoustic volume 308. In some particular cases, the microphone 334 is mounted to a support member that is configured to hold the microphone 334 in position to detect acoustic signals in the first acoustic volume 308. In certain implementations, the support member can extend from a wall in the housing and/or another support member in the earpiece 300. In still further implementations, the orientation of the microphone 334 can be varied, e.g., at an angle directed at least partially toward the first radiating surface 312 or toward the outlet 314.

The wall 330 can take any of a number of cross-sectional shapes, e.g., including one or more bends, corners, and/or contours, and is configured to separate the first acoustic volume 308 and the second acoustic volume 310. In certain cases, the wall 330 separates one or more portions (or, sub-volumes) of the second acoustic volume 310 from the first acoustic volume 308. In particular cases, the second acoustic volume 310 has an approximately constant cross-sectional width across a length thereof. For example, one or more sections of the second acoustic volume 310 have an approximately constant cross-sectional width across a given length. FIG. 3 illustrates one example where the cross-sectional width of portions of the second acoustic volume 310 are approximately constant, e.g., along sidewalls 328 of the transducer 306 as measured along the motion axis ($A_m$).

According to certain implementations, the second acoustic volume includes at least two acoustically coupled sub-volumes 310A, 310B. In certain of these cases, the second acoustic volume includes at least three acoustically coupled sub-volumes, for example, sub-volumes 310A, 310B, 310C. In particular cases, the acoustically coupled sub-volumes 310A, 310B, 310C, etc., have distinct volumes, e.g., where the volume 310A that is axially behind the transducer 306 (relative to $A_{mT}$) is larger than at least one of the other sub-volumes (e.g., 310B, 310C, etc.). It is understood that these sub-volumes are in fact fluidly coupled with one another, and that in some cases, delineation between sub-volumes can be defined by significant differences in the cross-sectional area of given sub-volumes. For example, a narrow passage between larger sub-volumes can qualify as a sub-volume, and act as a port between the larger sub-volumes.

In certain implementations, a ratio between the volume in one of the sub-volumes (e.g., sub-volumes 310A, 310B or 310C) and another one of the sub-volumes (e.g., a distinct one of sub-volumes 310A, 310B, or 310C) is equal to approximately 1:1 to approximately 4:1. In certain examples, a ratio between distinct sub-volumes is equal to approximately 2:1 to approximately 4:1. In more particular cases, the ratio between distinct sub-volumes is equal to approximately 3:1. In some implementations having at least three distinct sub-volumes (e.g., sub-volumes 310A, 310B, 310C), the ratio between sub-volume 310A and sub-volume 310C is equal to approximately 1:1 to approximately 4:1, and in more particular cases, approximately 2:1 to approximately 4:1, and in even more particular cases, approximately 3:1. The term "approximately" as used with respect to values herein can allot for a nominal variation from absolute values, e.g., of several percent or less. In some cases, the second acoustic volume 310 is at least approximately 75 cubic millimeters ($mm^3$). In particular aspects, the portion of the second acoustic volume 310 that is located between the first radiating surface 312 of the transducer 306 and the outlet 314 is at least approximately 25 $mm^3$.

In the particular example illustrated in FIG. 3, the acoustically coupled sub-volumes comprise at least three acoustically coupled sub-volumes 310A, 310B, 310C, where: the first sub-volume 310 has a first volume, the second sub-volume 310B has a second volume, and the third sub-volume 310C has a third volume. In some cases, the second sub-volume 310B is smaller than each of the first sub-volume 310A and the third sub-volume 310C. In particular examples, the third sub-volume 310C is smaller than the first sub-volume 310A. According to some implementations, the second sub-volume 310B acts as a port between the first sub-volume 310A and the third sub-volume 310C. In additional implementations, the second sub-volume 310B acts as a waveguide that acoustically couples the first sub-volume 310A and the third sub-volume 310C. In certain example implementations, the sub-volumes 310A, 310B, 310C each have distinct volumes.

According to various implementations, e.g., where the second acoustic volume 310 includes distinct sub-volumes 310A, 310B (and in some cases, 310C) that define ports and/or waveguides, the port and/or waveguide introduces an acoustic resonance in the earpiece (e.g., earpiece 300). For example, a port or waveguide in the second acoustic volume 310 can introduce an effective peak in the mechanical admittance of the transducer 306, thereby producing more displacement per input force over a local frequency range.

Figure 4:
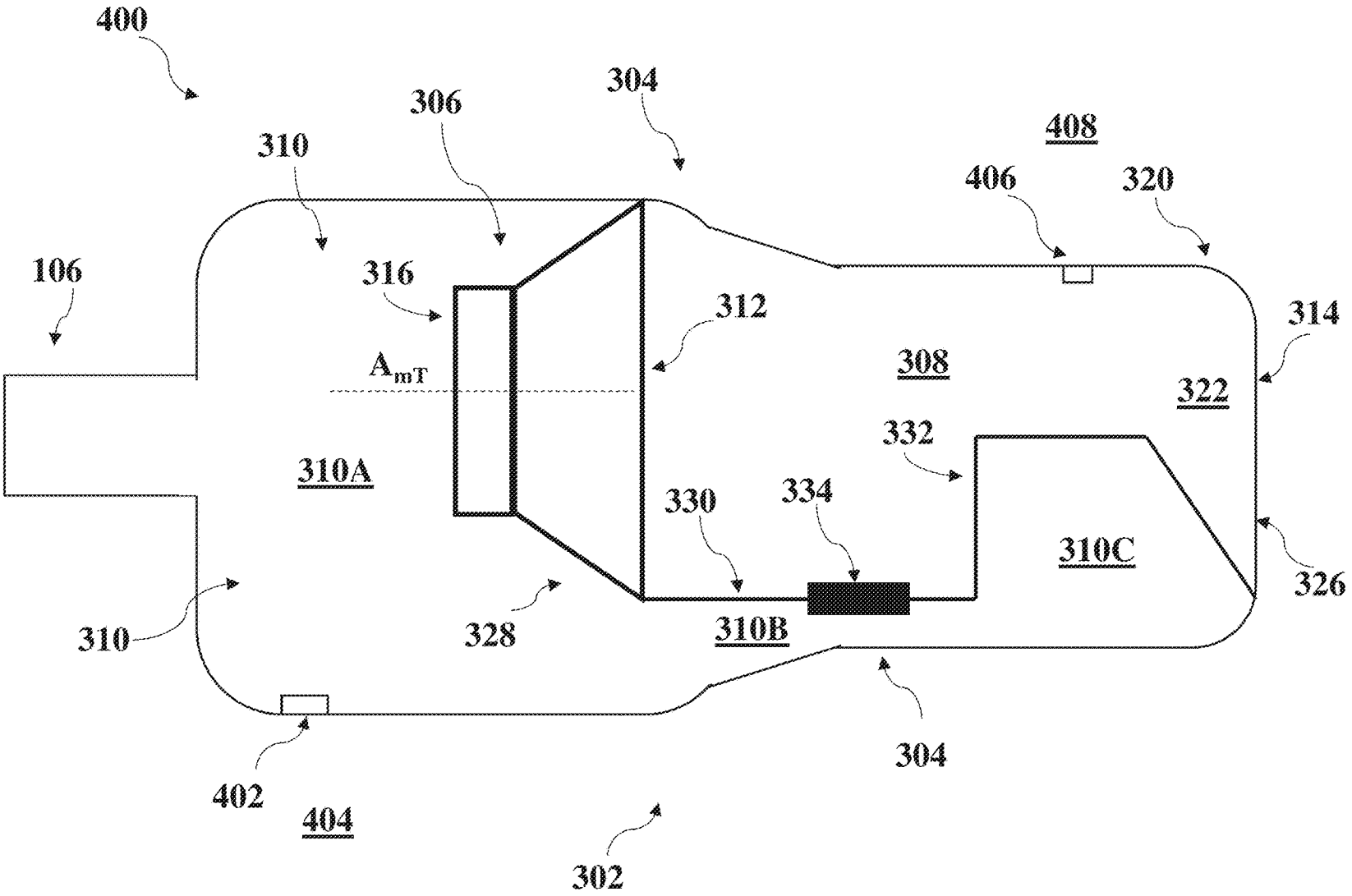
FIG. 4 is a cross-sectional depiction of an additional earpiece in an audio device according to various implementations.
Figure 5:
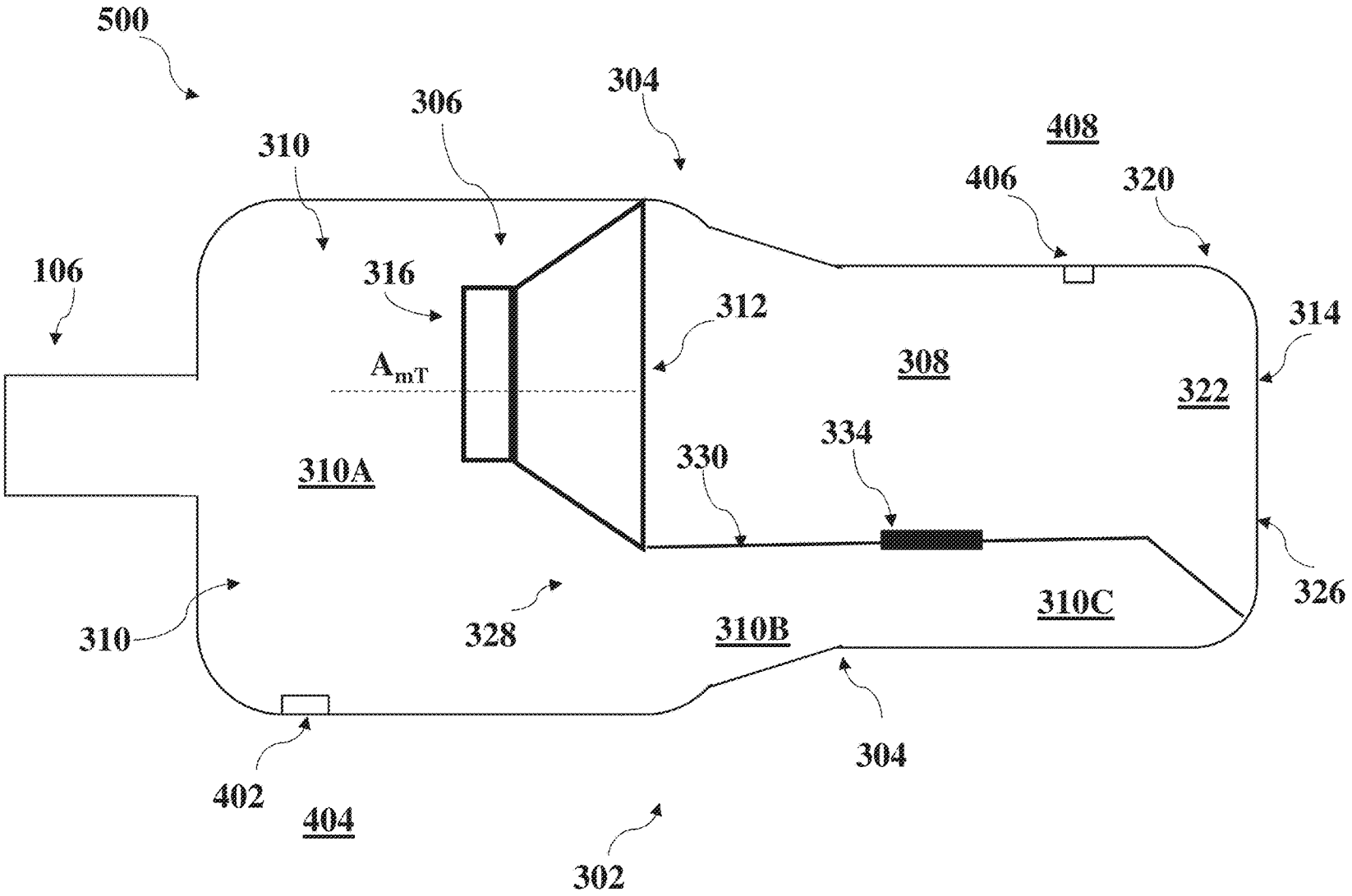
FIG. 5 is a cross-sectional depiction of another earpiece in an audio device according to various implementations.

FIG. 4 illustrates a variation on an earpiece 400 with a distinct ratio of sub-volumes 310A, 310B, 310C as compared with the earpiece 300 in FIG. 3. FIG. 4 also shows the microphone 334 in a portion of the wall 330 that defines the second sub-volume 310B. In this example, sub-volume 310B can function as a port between sub-volumes 310A and 310C. In certain of these cases, sub-volume 310B has a narrower cross-sectional width (e.g., as measured from interior wall 330 to housing 304), and in particular cases, a lesser volume, than sub-volumes 310A and 310C. FIG. 5 illustrates an additional variation on an earpiece 500, with a distinct ratio of sub-volumes 310A, 310B, 310C as compared with earpiece 300 (FIG. 3) and earpiece 400 (FIG. 4). In this example, sub-volumes 310A, 310B and 310C can act as a waveguide for acoustic energy radiated into the second volume 310 from the second radiating surface 316. In certain of these cases, sub-volumes 310B and 310C have similar cross-sectional widths (e.g., as measured from interior wall 330 to housing 304), and in particular cases, have similar volumes (e.g., less than approximately 5-10 percent variation in cross-sectional width or volume). A number of variations on the location of wall(s) 330, sizes of sub-volumes 310A, 310B, 310C, etc. and locations of microphone(s) 334 not necessarily depicted herein are possible within the various implementations.

With reference to FIGS. 3-5, earpieces disclosed herein (e.g., earpiece 300 in FIG. 3, earpiece 400 in FIG. 4, earpiece 500 in FIG. 5) can also include a rear port 402 coupling the second acoustic volume 310 with a space 404 outside the housing 304. In particular cases, the earpiece (e.g., earpiece 300, earpiece 400, earpiece 500) can also include a front port 406 coupling the first acoustic volume 308 with a space 408 outside the housing 304. In some cases, the rear port 402 and front port 406 couple to distinct spaces 404, 408 outside the housing 304, however, in other implementations, the spaces 404 and 408 are the connected (e.g., ambient air). In particular cases, the rear port 402 and the front port 406 are coupled with one another within the housing 304, e.g., within walls in the housing or in an additional volume separate from the first and second acoustic volumes 308, 310. In some examples, the rear port 402 and front port 406 are acoustically coupled into a combined exit volume, such as described in U.S. application Ser. No. 16/990,358, filed Aug. 11, 2020, the complete disclosure of which is incorporated herein by reference. In such cases, a port or ports may be included in any one of, all of, or any combination of the front portion of the back volume, the front portion of the back volume or the connecting portion of the back volume. In some cases, the port(s) are approximately at least one millimeter (mm) long and approximately at least 1 to 2 $mm^2$ in cross-sectional area (e.g., between approximately 1.5 to 2 $mm^2$ in some cases, and approximately 1.8 $mm^2$ in more particular cases).

Figure 6:
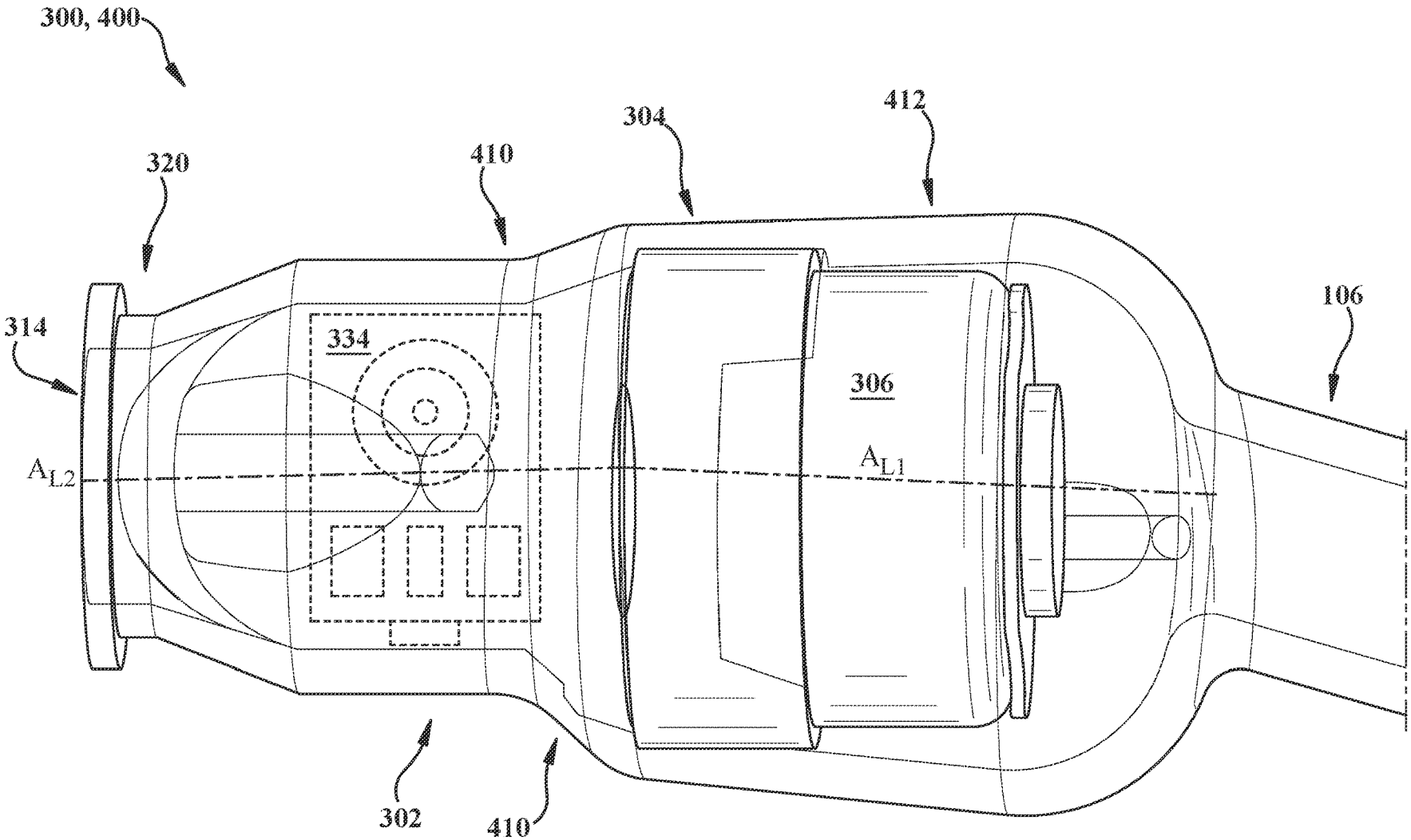
FIG. 6 is a partially transparent perspective view of an earpiece in an audio device according to various implementations.
Figure 7:
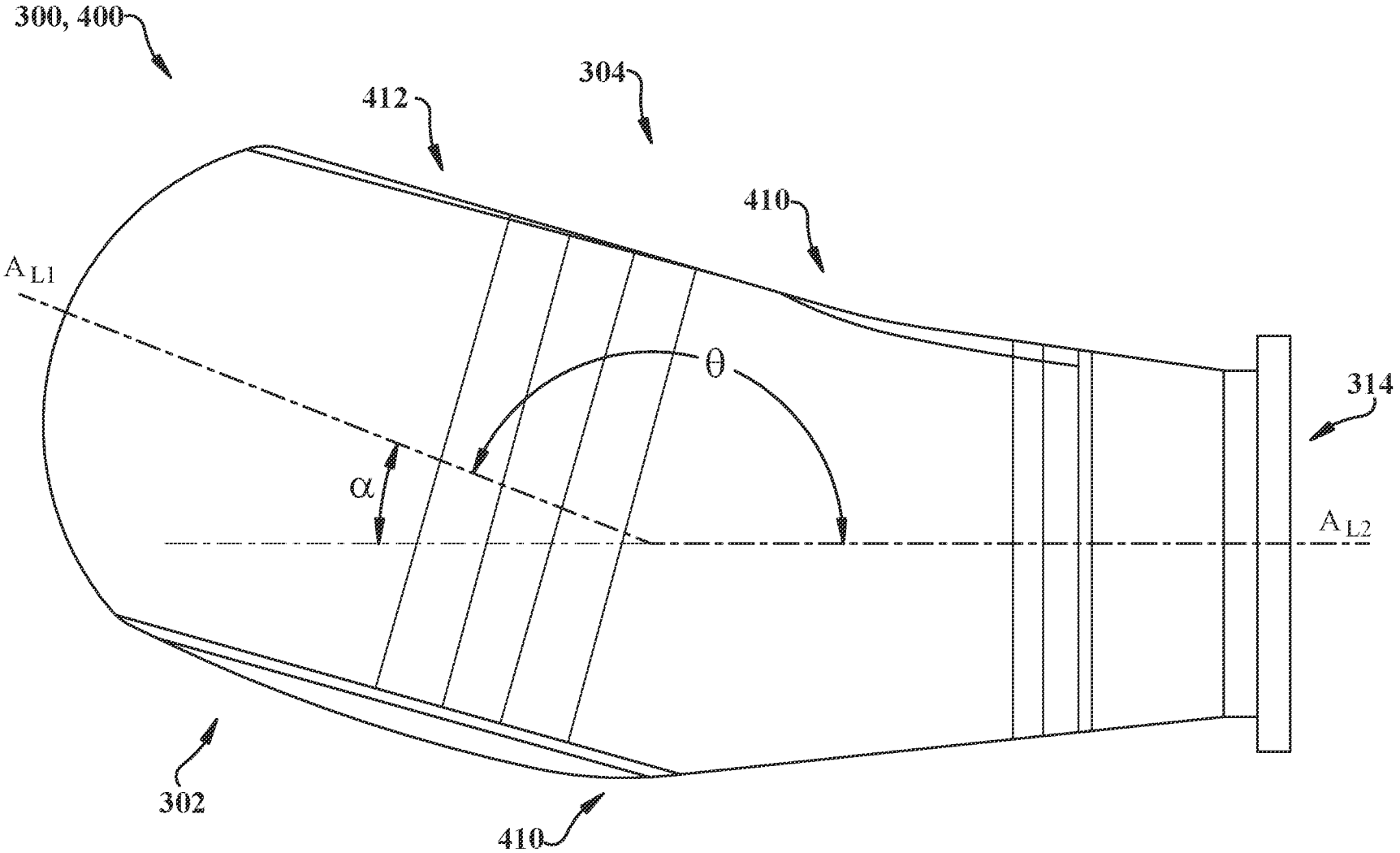
FIG. 7 is an external perspective of an earpiece in an audio device according to various implementations.

According to various implementations of the audio devices described herein, the housing can be shaped to enhance fit within the user's ear. For example, as illustrated in the schematic depictions of housing 304 in FIG. 5 (partially transparent view) and particularly in FIG. 6 (external view), the housing 304 includes a contour 410 configured to complement a user's ear canal shape. In these cases, the housing 304 defines a main body 412 having a first longitudinal axis ($A_{L1}$) and a nozzle 320 having a second longitudinal axis ($A_{L2}$) that intersects with the first longitudinal axis ($A_{L1}$). As described herein and depicted in FIGS. 3 and 4, the transducer 306 is supported in the main body 412 such that the motion axis ($A_{mT}$) is substantially parallel to the first longitudinal axis ($A_{L1}$), and the first and second longitudinal axes ($A_{L1}$, $A_{L2}$) are arranged at a non-zero angle ($\alpha$) relative to each other. This non-zero angle ($\alpha$) is illustrated, for example, in FIG. 6. In other terms, this contour 410 can be measured by the complementary angle ($\theta$) that is less than 180 degrees between the axes ($A_{L1}$, $A_{L2}$), illustrated in FIG. 6.

Relative to conventional audio devices, in particular, conventional RIC hearing aids, the audio devices including earpieces disclosed herein can provide a number of benefits. For example, various implementations include earpieces with an electro-acoustic transducer (e.g., moving coil transducer) that is positioned to enable a reliable, comfortable fit across a range of users (and corresponding ear canal geometries), without sacrificing acoustic performance. That is, the earpieces disclosed according to various implementations are configured to fit a wide range of users and provide desired acoustic performance (e.g., output, noise cancelation, etc.). The earpieces disclosed according to various implementations can be beneficially incorporated into a variety of wearable audio devices, and may provide particular benefits in those devices designed to be worn in-ear or on-ear by users. Even further, in the example of hearing aids or other in-ear devices, the earpieces disclosed according to various implementations can be worn more discreetly than conventional earpieces due improved fit within the canal. The lateral dimension and taper of the earpieces disclosed herein enables those earpieces to be comfortably positioned deeper in the ear canal than conventional in-ear devices. Further, the configurations of the transducer, microphone, and acoustic volumes disclosed according to implementations enables use of a moving coil transducer that provides enhanced output capability for active noise reduction, as well as wider bandwidth audio, when compared with conventional in-ear devices such as RIC hearing aids.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, accessories (e.g., electronic components) described as being "coupled" can be linked via conventional hard-wired and/or wireless means such that these accessories can communicate data with one another. Additionally, sub-components within a given component can be considered to be linked via conventional pathways, which may not necessarily be illustrated.

Other embodiments not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

I claim:

1. An earpiece, comprising:

an electro-acoustic transducer;

a housing supporting the electro-acoustic transducer such that the housing and the electro-acoustic transducer together define a first acoustic volume and a second acoustic volume, the electro-acoustic transducer being arranged such that a first radiating surface of the transducer radiates acoustic energy into the first acoustic volume coupled to an outlet and such that a second radiating surface of the transducer radiates acoustic energy into the second acoustic volume, wherein at least a portion of the second acoustic volume is located between the first radiating surface and the outlet, wherein the first acoustic volume and the second acoustic volume are acoustically isolated within the housing, the earpiece further comprising:

a rear port coupling the second acoustic volume with a space outside the housing; and a front port coupling the first acoustic volume with a space outside the housing, wherein the front port is distinct from the outlet, wherein the front port and the rear port are acoustically coupled into a combined exit volume, wherein the combined exit volume is the only acoustic connection between the first acoustic volume and the second acoustic volume.

2. The earpiece of claim 1, wherein the electro-acoustic transducer comprises a moving coil transducer.

3. The earpiece of claim 2, wherein the housing has a longitudinal axis, and wherein the moving coil transducer comprises a diaphragm with a motion axis that is approximately parallel with the longitudinal axis of the housing.

4. The earpiece of claim 1, wherein the housing defines a nozzle, and wherein the first acoustic volume is acoustically coupled to an acoustic passage in the nozzle such that the electro-acoustic transducer is acoustically coupled to a user's ear canal when the earpiece is worn, the earpiece further comprising an ear tip supported on the nozzle, wherein: the ear tip is either configured to form a tight acoustic seal with the user's ear canal when the earpiece is worn, or the ear tip includes a set of apertures that allow acoustic energy to move into and out of the user's ear canal.

5. The earpiece of claim 1, wherein the housing defines a main body having a first longitudinal axis and a nozzle having a second longitudinal axis that intersects with the first longitudinal axis, wherein the electro-acoustic transducer is supported in the main body and such that a motion axis of the electro-acoustic transducer is substantially parallel to the first longitudinal axis, and wherein the first and second longitudinal axes are arranged at a non-zero angle relative to each other.

6. The earpiece of claim 1, wherein the outlet comprises an acoustic outlet to an ear canal of a user of the earpiece, and wherein the outlet is at least partially covered by at least one of: a screen, a mesh material, a thin foam, a reticulated foam, an open-cell foam, an expanded polymer, or a dome cover.

7. The earpiece of claim 1, wherein the second acoustic volume comprises at least two acoustically coupled sub-volumes.

8. The earpiece of claim 7, wherein the acoustically coupled sub-volumes have distinct volumes.

9. The earpiece of claim 8, wherein a ratio between a first sub-volume in the acoustically coupled sub-volumes and a second sub-volume in the acoustically coupled sub-volumes is equal to a range of approximately 1:1 to approximately 4:1.

10. The earpiece of claim 8, wherein the acoustically coupled sub-volumes comprise at least three acoustically coupled sub-volumes, comprising:

a first sub-volume having a first volume;

a second sub-volume having a second volume; and a third sub-volume having a third volume, wherein the second sub-volume is smaller than each of the first sub-volume and the third sub-volume and acts as a port between the first sub-volume and the third sub-volume.

11. The earpiece of claim 8, wherein the acoustically coupled sub-volumes comprise at least three acoustically coupled sub-volumes, comprising:

a first sub-volume having a first volume;

a second sub-volume having a second volume; and a third sub-volume having a third volume, wherein the second sub-volume acts as a waveguide that acoustically couples the first sub-volume and the third sub-volume.

12. The earpiece of claim 1, wherein the first acoustic volume and the second acoustic volume are separated by a wall, wherein at least a portion of the wall is located between the first radiating surface and the outlet, the earpiece further comprising a microphone in the portion of the wall located between the first radiating surface and the outlet, wherein the microphone detects acoustic signals from the first acoustic volume.

13. The earpiece of claim 1, wherein the second acoustic volume is at least approximately 75 cubic millimeters ($mm^3$).

14. A hearing aid comprising the earpiece of claim 2, the hearing aid further comprising:

a casing configured to sit behind a user's pinna when worn; and wiring coupling the casing to the earpiece, wherein the outlet comprises an acoustic outlet to an ear canal of a user of the earpiece.

15. The hearing aid of claim 14, further comprising: a battery, a microphone and a sound processor housed in the casing.

16. An in-ear audio device comprising the earpiece of claim 1.

17. An on-ear audio device comprising the earpiece of claim 1.

18. The earpiece of claim 1, wherein the outlet comprises an acoustic outlet to an ear canal of a user of the earpiece.

19. The earpiece of claim 10, wherein the port introduces an acoustic resonance in the earpiece across a range of frequencies.

20. An earpiece, comprising:

an electro-acoustic transducer;

a housing supporting the electro-acoustic transducer such that the housing and the electro-acoustic transducer together define a first acoustic volume and a second acoustic volume, the electro-acoustic transducer being arranged such that a first radiating surface of the transducer radiates acoustic energy into the first acoustic volume coupled to an outlet and such that a second radiating surface of the transducer radiates acoustic energy into the second acoustic volume, wherein at least a portion of the second acoustic volume is located between the first radiating surface and the outlet, and wherein the first acoustic volume and the second acoustic volume are acoustically isolated in the housing and separated by a wall, wherein at least a portion of the wall is located between the first radiating surface and the outlet, the earpiece further comprising a microphone in the portion of the wall located between the first radiating surface and the outlet, wherein the microphone detects acoustic signals from the first acoustic volume.

21. An in-ear audio device comprising the earpiece of claim 20.

22. An earpiece, comprising:

an electro-acoustic transducer;

a housing supporting the electro-acoustic transducer such that the housing and the electro-acoustic transducer together define a first acoustic volume and a second acoustic volume, the electro-acoustic transducer being arranged such that a first radiating surface of the transducer radiates acoustic energy into the first acoustic volume coupled to an outlet and such that a second radiating surface of the transducer radiates acoustic energy into the second acoustic volume, wherein at least a portion of the second acoustic volume is located between the first radiating surface and the outlet, wherein the second acoustic volume comprises at least three acoustically coupled sub-volumes, comprising:

a first sub-volume having a first volume;

a second sub-volume having a second volume; and a third sub-volume having a third volume, wherein the second sub-volume is smaller than each of the first sub-volume and the third sub-volume and acts as a port between the first sub-volume and the third sub-volume, and wherein the port introduces an effective peak in a mechanical admittance of the transducer.

23. An earpiece, comprising:

an electro-acoustic transducer;

a housing supporting the electro-acoustic transducer such that the housing and the electro-acoustic transducer together define a first acoustic volume and a second acoustic volume, the electro-acoustic transducer being arranged such that a first radiating surface of the transducer radiates acoustic energy into the first acoustic volume coupled to an outlet and such that a second radiating surface of the transducer radiates acoustic energy into the second acoustic volume, wherein at least a portion of the second acoustic volume is located between the first radiating surface and the outlet, wherein the second acoustic volume comprises at least three acoustically coupled sub-volumes, comprising:

a first sub-volume having a first volume;

a second sub-volume having a second volume; and a third sub-volume having a third volume, wherein the second sub-volume acts as a waveguide that acoustically couples the first sub-volume and the third sub-volume, and wherein the waveguide introduces an effective peak in a mechanical admittance of the transducer.

* * * * *